US008118405B2

(12) United States Patent
Xie et al.

(10) Patent No.: US 8,118,405 B2
(45) Date of Patent: Feb. 21, 2012

(54) BUTTABLE PRINTHEAD MODULE AND PAGEWIDE PRINTHEAD

(75) Inventors: Yonglin Xie, Pittsford, NY (US); Christopher R. Morton, Rochester, NY (US); Gary A. Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 461 days.

(21) Appl. No.: 12/337,665

(22) Filed: Dec. 18, 2008

(65) Prior Publication Data

US 2010/0156992 A1 Jun. 24, 2010

(51) Int. Cl.
*B41J 2/14* (2006.01)

(52) U.S. Cl. ..... 347/49

(58) Field of Classification Search ..... 347/20, 347/40, 49, 50

See application file for complete search history.

(56) References Cited

U.S. PATENT DOCUMENTS

| | | | |
|---|---|---|---|
| 4,463,359 | A | 7/1984 | Ayata et al. |
| 4,822,755 | A | 4/1989 | Hawkins et al. |
| 4,961,821 | A | 10/1990 | Drake et al. |
| 4,985,710 | A | 1/1991 | Drake et al. |
| 5,079,189 | A | 1/1992 | Drake et al. |
| 5,098,503 | A | 3/1992 | Drake |
| 5,160,403 | A | 11/1992 | Fisher et al. |
| 5,198,054 | A | 3/1993 | Drake et al. |
| 5,257,043 | A | 10/1993 | Kneezel |
| 5,572,244 | A | 11/1996 | Drake et al. |
| 5,620,614 | A | 4/1997 | Drake et al. |
| 5,706,176 | A | 1/1998 | Quinn et al. |
| 5,719,605 | A | 2/1998 | Anderson et al. |
| 6,428,142 | B1 | 8/2002 | Silverbrook et al. |
| 6,575,561 | B1 | 6/2003 | Silverbrook |
| 6,623,106 | B2 | 9/2003 | Silverbrook |
| 6,655,786 | B1 | 12/2003 | Foote et al. |
| 7,350,902 | B2 | 4/2008 | Dietl et al. |
| 2004/0218013 | A1 | 11/2004 | Silverbrook et al. |
| 2005/0046669 | A1 | 3/2005 | Silverbrook |
| 2006/0152547 | A1 | 7/2006 | Silverbrook et al. |
| 2007/0206051 | A1 | 9/2007 | Silverbrook |
| 2007/0206052 | A1 | 9/2007 | Silverbrook |
| 2007/0291082 | A1 | 12/2007 | Baumer et al. |
| 2008/0180485 | A1 | 7/2008 | Delametter et al. |

FOREIGN PATENT DOCUMENTS

| | | |
|---|---|---|
| EP | 0 914 950 | 5/1999 |
| JP | 05-162319 | 6/1993 |
| WO | WO 2004/056572 | 7/2004 |

*Primary Examiner* — An Do
(74) *Attorney, Agent, or Firm* — William R. Zimmerli

(57) ABSTRACT

A printhead module includes a substrate, a plurality of drop ejector arrays, and electronic circuitry. The substrate includes a butting edge extending in a first direction along the substrate. The plurality of drop ejector arrays extends substantially parallel to the butting edge of the substrate with a first drop ejector array of the plurality of drop ejector arrays being closest to the butting edge of the substrate. A portion of the electronic circuitry is disposed between the first drop ejector array and the butting edge of the substrate.

23 Claims, 11 Drawing Sheets

BUTTABLE PRINTHEAD MODULE AND PAGEWIDE PRINTHEAD

FIELD OF THE INVENTION

The present invention relates generally to digitally controlled printing systems, and more particularly to making a pagewidth printhead by butting a plurality of printhead modules.

BACKGROUND OF THE INVENTION

An inkjet printing system typically includes one or more printheads and their corresponding ink supplies. Each printhead includes an ink inlet that is connected to its ink supply and an array of drop ejectors with each ejector including an ink chamber, an ejecting actuator and an orifice through which droplets of ink are ejected. The ejecting actuator may be one of various types, including a heater that vaporizes some of the ink in the chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as relative motion between the print medium and the printhead is established.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are often referred to as pagewidth printheads.

Manufacturing yield of printhead die decreases for larger die sizes, and in many applications it is not economically feasible to fabricate a pagewidth printhead using a single printhead die that spans the width of the print medium, especially when the width of the print medium is larger than four inches. At the same time, the cost of assembly of the plurality of printhead die makes it economically unfeasible to fabricate a pagewidth printhead if the individual printhead die are too small. In order to provide high quality printing, a printhead die suitable for use as a subunit of a pagewidth printhead may have a nozzle density of 1200 nozzles per inch, and have several hundred to more than one thousand drop ejectors on a single die. In order to control the firing of so many drop ejectors on a printhead die, it is preferable to integrate driving transistors and logic circuitry onto the printhead die.

As such, there is a need for a buttable printhead module having driving electronics and logic integrated so that a sufficiently large numbers of drop ejectors can be incorporated on a single module, where sufficient room is available at the butting edge so that drop ejectors and associated electronics are not damaged during separation of the module from the wafer. What is also needed is an alignment feature at the butting edge of the module to accomplish alignment of the modules in both directions in the plane of the modules.

SUMMARY OF THE INVENTION

According to an aspect of the present invention, a modular printhead includes a first printhead and a second printhead. The first printhead module includes a first alignment feature and at least one array of dot forming elements extending in a first direction along a first substrate. A plurality of electrical contacts is operatively associated with the at least one array of dot forming elements. The plurality of electrical contacts extends in a second direction along the first substrate. The second printhead module includes a second alignment feature and at least one array of dot forming elements extending in a first direction along a second substrate. A plurality of electrical contacts is operatively associated with the at least one array of dot forming elements. The plurality of electrical contacts extends in a second direction along the second substrate. The first direction and the second direction of the first printhead module and the second printhead module are positioned at an angle θ relative to each other, in which $0°<\theta<90°$. The first alignment feature of the first printhead module and the second alignment feature of the second printhead module are contactable with each other.

According to another aspect of the present invention, a printhead module includes a substrate and a drop ejector array extending in a first direction along the substrate. A plurality of electrical contacts is operatively associated with the at least one drop ejector array. The plurality of electrical contacts extends in a second direction along the substrate with the first direction and the second direction being positioned at an angle θ relative to each other, in which $0°<\theta<90°$.

According to another aspect of the present invention, a printhead module includes a substrate, a plurality of drop ejector arrays, and electronic circuitry. The substrate includes a butting edge extending in a first direction along the substrate. The plurality of drop ejector arrays extends substantially parallel to the butting edge of the substrate with a first drop ejector array of the plurality of drop ejector arrays being closest to the butting edge of the substrate. A portion of the electronic circuitry is disposed between the first drop ejector array and the butting edge of the substrate.

According to another aspect of the present invention, a method of forming an individual printhead module including an alignment feature includes providing a wafer including a plurality of printhead modules; forming a first alignment feature on a first printhead module of the plurality of printhead modules and forming a complementary second alignment feature on a second printhead module of the plurality of printhead modules using an etching process; and separating the plurality of printhead modules using a cutting operation.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
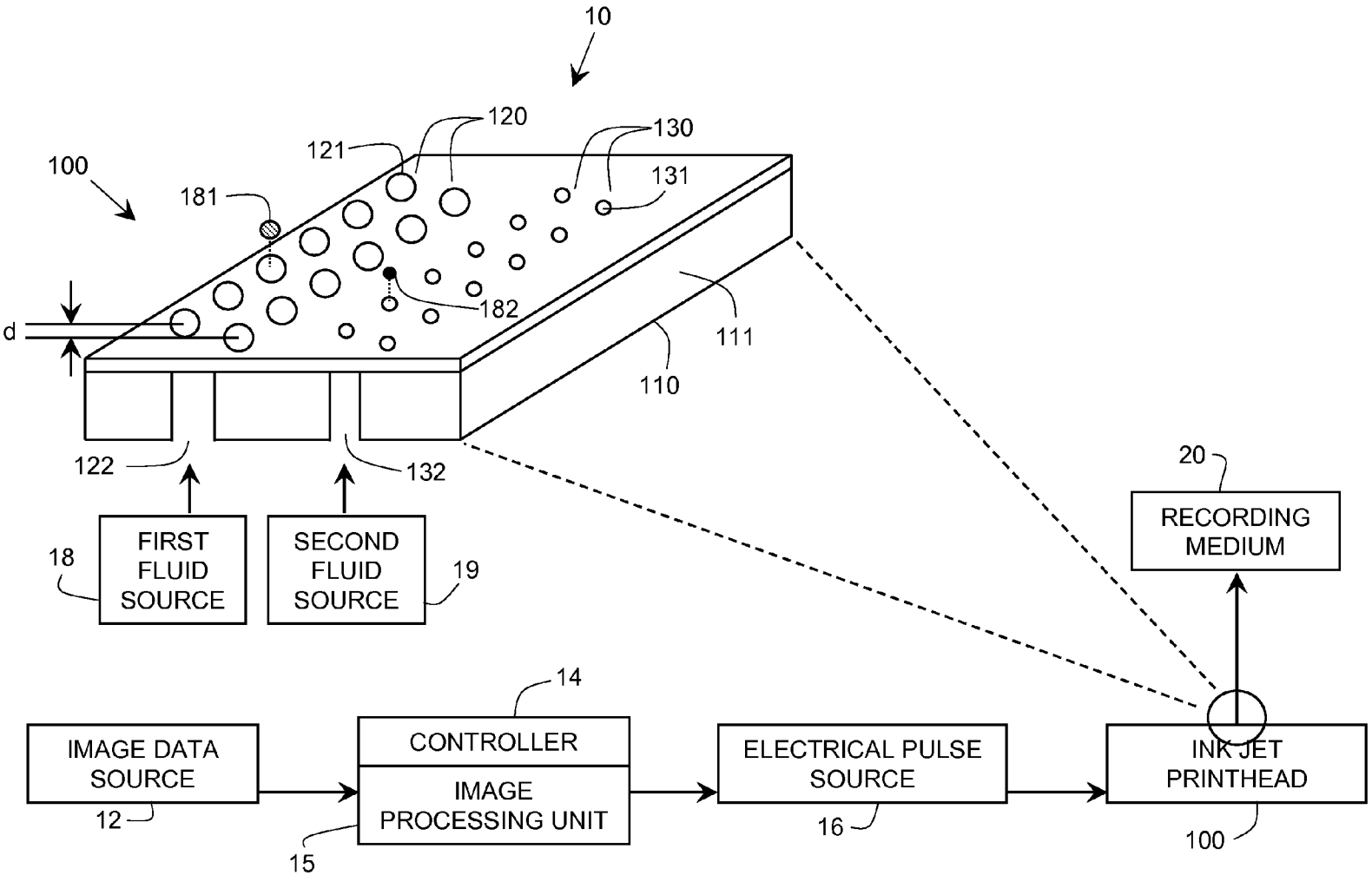
FIG. 1 is a schematic representation of an inkjet printer system.

Referring to FIG. 1, a schematic representation of an inkjet printer system 10 suitable for use with the present invention is shown. Printer system 10 is described in U.S. Pat. No. 7,350,902, the disclosure of which is incorporated by reference herein. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles in the first array 121 in the first nozzle array 120 have a larger opening area than nozzles in the second array 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of fluid delivery pathways 122 and 132 are shown in FIG. 1 as openings through printhead die substrate 111. One or more inkjet printhead die 110 are included in inkjet printhead 100, but for greater clarity only one inkjet printhead die 110 is shown in FIG. 1. The printhead die are arranged on a support member as discussed below with reference to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to nozzle the first nozzle array 120 and the second nozzle array 130 via ink delivery pathways 122 and 132 respectively. Also, in some embodiments, fewer than two or more than two nozzle arrays may be included on printhead die 110. In some embodiments, all nozzles on inkjet printhead die 110 may be the same size, rather than having multiple sized nozzles on inkjet printhead die 110.

Drop forming mechanisms are associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. A drop ejector includes both a drop forming mechanism and a nozzle. Since each drop ejector includes a nozzle, a drop ejector array can also be called a nozzle array.

Electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms associated respectively with nozzle arrays 120 and 130 are also sized differently in order to optimize the drop ejection process for the different sized drops. During operation, droplets of ink are deposited on a recording medium 20.

Figure 2:
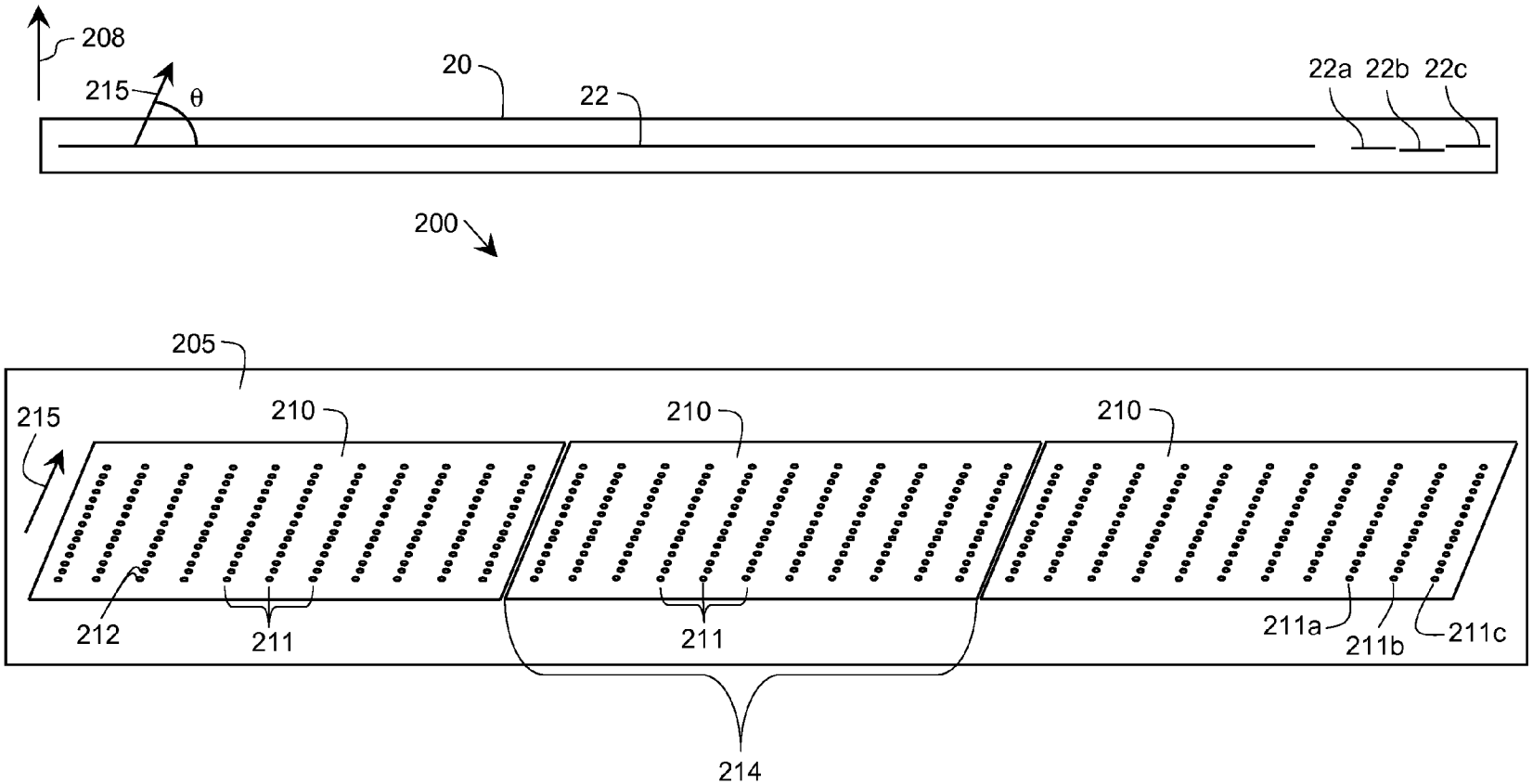
FIG. 2 is a schematic top view of a modular printhead according to an embodiment of this invention.

FIG. 2 shows a schematic top view of a modular printhead 200 according to an embodiment of this invention. Modular printhead 200 includes three printhead modules 210 (similar to inkjet printhead die 110 but not having nozzles in staggered rows) that are bonded to a support member 205. Each printhead module 205 includes several arrays 211 of drop ejectors 212, where the arrays 211 extend in a first direction 215 (also called array direction 215). Each printhead module 205 has two butting edges 214 that are substantially parallel to first direction 215, so that the arrays 211 are substantially parallel to the butting edges 214 of the printhead module 205. In FIG. 2, a gap is shown between the butting edges 214 of adjacent printhead modules in order to distinguish the different printhead modules 205.

A portion of a sheet of recording medium 20 is shown near the modular printhead 200, and a raster line 22 of image data printed by modular printhead 200 is indicated. Array direction 215 is at an angle θ relative to raster line 22. Toward the right side of FIG. 2, raster line 22 has been broken up into three segments 22*a*, 22*b* and 22*c* which are displaced from one another so that they may be more readily distinguished. The pixels in raster line segments 22*a*, 22*b* and 22*c* are printed by arrays 211*a*, 211*b* and 211*c* respectively. Recording medium 20 is moved along media advance direction 208 during printing. The firing of the different drop ejectors 212 within arrays 211 is timed relative to one another so that ink drops land on the horizontal raster line 22, rather than in the sawtooth arrangement of the arrays 211. Drop ejectors 212 within an array 211 are arranged such that the projection of the uppermost drop ejector of one array 211 onto raster line 22 is adjacent to the projection of the lowermost drop ejector of the adjacent array 211 onto raster line 22. In other words, the uppermost drop ejector of one array 211 is "projectionally adjacent" to the lowermost drop ejector of the adjacent array 211. In this way, the printed dots making up raster line 22 all have the same horizontal spacing. When the adjacent arrays 211 are on different modules 210, the spacing at the adjacent butting edges 214 needs to be correct so that the projections of the uppermost drop ejector 212 and the lowermost drop ejector onto raster line 22 have the correct horizontal spacing and so that there is not a stitch error seen in the raster line 22. In, addition, adjacent die modules 210 should not be displaced from one another along direction 208, or displaced line segments will result at the stitch in the raster line 22.

Figure 3:
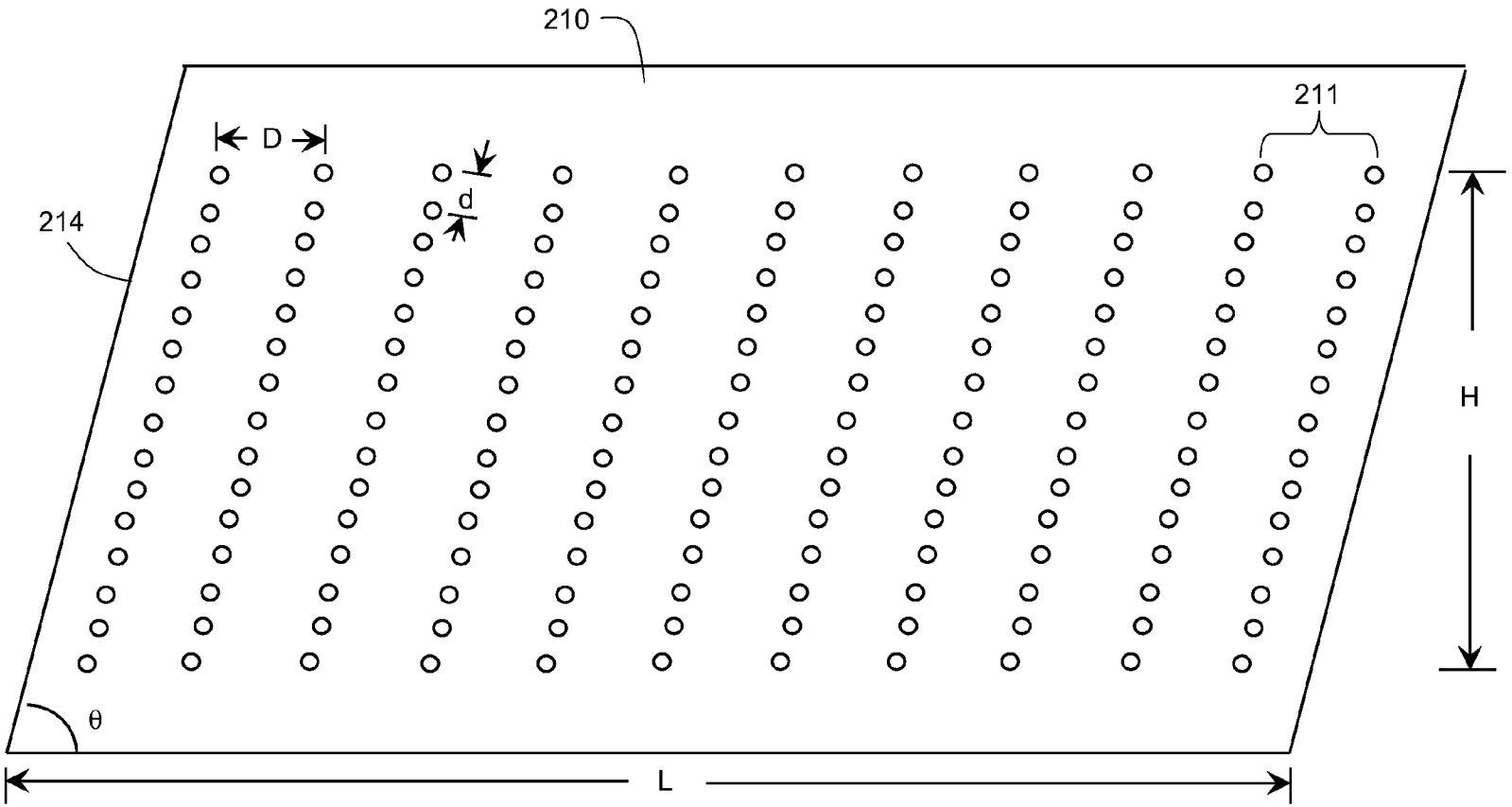
FIG. 3 is a schematic top view of a single printhead module according to an embodiment of this invention.

A schematic top view of a single printhead module 210 is shown magnified in FIG. 3 in order to clarify the geometry of the arrays 211. The center to center distance between two corresponding nozzles in adjacent arrays 211 is denoted as D. The center to center distance between two adjacent nozzles in the same array 211 is denoted as d. The number of drop ejectors 212 within a single array 211 is n. The number of arrays 211 on a printhead module 210 is m, so that the total number of drop ejectors 212 within a printhead module is N=m×n. In the example shown in FIG. 3, n=15, m=11 and N=165.

In order to have the proper horizontal spacing of printhead dots on the raster line 22, D=nd cos θ. The distance from butting edge 214 to the nearest array 211 is approximately D/2. By appropriately selecting n, d and θ when designing printhead module 210, a large enough D/2 can be provided so that there is room for electronic circuitry, ink delivery, and alignment features between butting edge 214 and the nearest array 211. For example, if d=42.3 microns, n=32 and θ=60 degrees, then D=677 microns. The overall length L of the module 210 is L=mD. For a printhead module 210 having 640 drop ejectors 212 in m=20 arrays 211 of n=32 drop ejectors, the length L of the printhead module 210 is 13.54 mm. In this same example, the horizontal spacing of dots on raster line 22 is d cos θ=21.7 microns, i.e. 1200 dots per inch. The height H of the array 211 (a vertical projection of the distance from the uppermost nozzle in the array to the lowermost nozzle) is (n−1) d sin θ=1.14 mm in this example, so the overall height of the printhead module 210 including space for electrical contacts at the non butting edges of the printhead module 210 could be approximately 1.3 mm.

The horizontal spacing of dots on raster line 22 can be modified by designing a printhead module having a different angle θ. Because d cos θ decreases as θ approaches 90 degrees, the larger that θ is, the smaller will be the horizontal spacing of dots on raster line 22 (i.e. the higher the printing resolution). For θ=60 degrees, cos θ=0.5. While θ can range between 0 degrees and 90 degrees, most embodiments will have a value of θ that is between 45 degrees and about 85 degrees.

Figure 4:
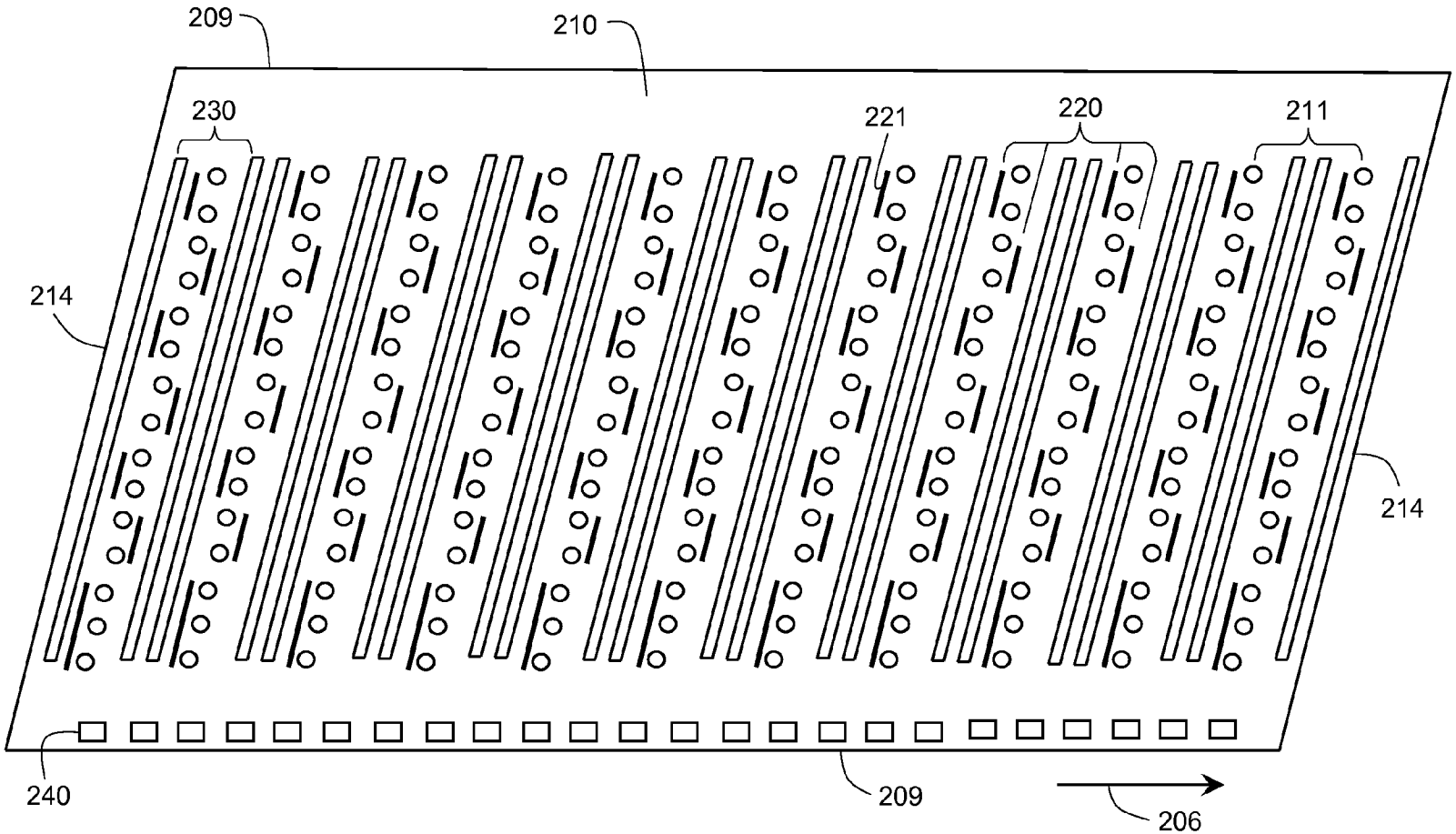
FIG. 4 is a schematic top view of the example shown in FIG. 3, but also showing additional details including ink inlets, electrical contacts and electronic circuitry.

FIG. 4 is a schematic top view of the example shown in FIG. 3, but also showing additional details including ink inlets 220, electronic circuitry 230, and electrical contacts 240. The ink inlets 220 (shown in the example of FIG. 4 as staggered segments on both sides of each array 211) are of the dual feed type described in more detail in US Patent Application Publication No. US 2008/0180485 A1. Ink can be fed from the back side of printhead module 210 to adjacent groups of drop ejectors by segmented ink inlets 220 consisting of slots 221 that can be made, for example, as described in U.S. patent application Ser. No. 12/241,747, filed Sep. 30, 2008, Lebens et al. Electronic circuitry 230 can include driver transistors to provide electrical pulses from electrical pulse source 16 to fire the drop ejectors 212, as well as logic electronics to control the driver transistors so that the correct drop ejectors 212 are fired at the proper time, according to image data provided by controller 14 and image processing unit 15. Leads from the driver transistors are able to access the appropriate drop ejectors 212 from either side of array 211 between slots 221. Electrical signals are provided to printhead module 210 by a plurality of electrical contacts 240, which extend along one or both nonbutting edges 209 of printhead module 210 along direction 206. Electrical contacts 240 are interconnected by wire bonding or tape automated bonding, for example, to a circuit board (not shown in FIG. 2) on support member 205. Because of the inclusion of the logic and driver circuitry in electronic circuitry 230, relatively few electrical contacts 240 (on the order of twenty) are required for firing the hundreds of drop ejectors 211. Note that each array 211 of drop ejectors 212, including the arrays 211 nearest the butting edges 214, has associated electronic circuitry 230 located on both sides of the array 211. As a result, a portion of the electronic circuitry 230 on printhead module 210 is located between a butting edge 214 and the array 211 of drop ejectors 212 that is closest to (and substantially parallel to) that butting edge 214.

Figure 5:
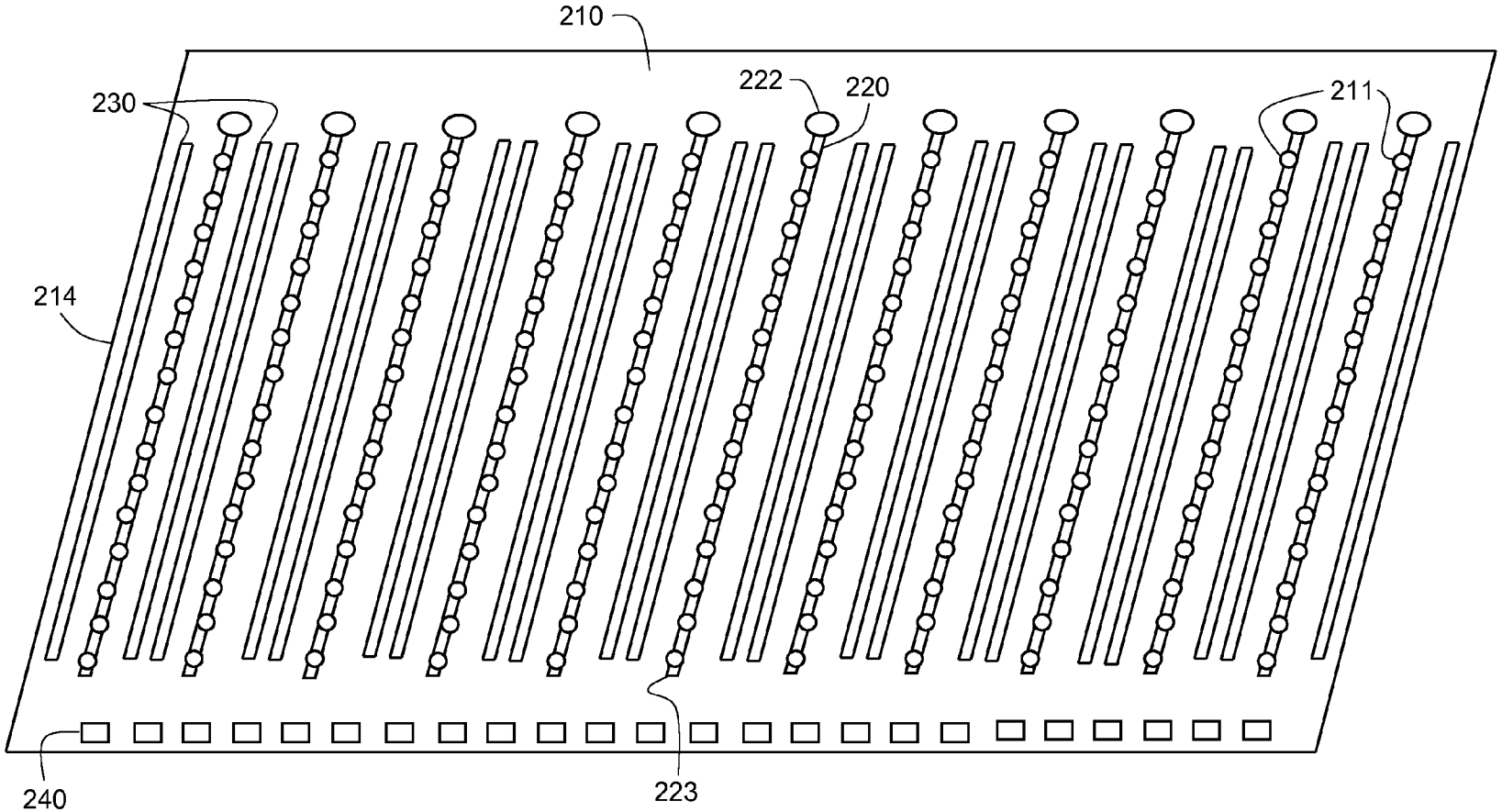
FIG. 5 is a schematic top view of an embodiment that is similar to that of FIG. 4, but with a different type of ink inlets.

FIG. 5 is a schematic top view of an embodiment that is similar to that of FIG. 4, but with a different type of ink inlets 220, such that the ink flows continuously beneath the corresponding array 211, from one end of the array to another end. In FIG. 5, the ink inlets 220 have a first end 222 from which the ink flows (beneath the array 211) toward a second end 223. Ink can exit at the backside of printhead module 211 from second end 223 and be recirculated to enter at the backside near first end 222. As described in US Patent Application Publication No. US 2007/0291082 A1, a second flow path (not shown in FIG. 5, but optionally below the first flow path) can be provided opposite the first flow path in order to provide stagnation points adjacent each nozzle opening.

Figure 6:
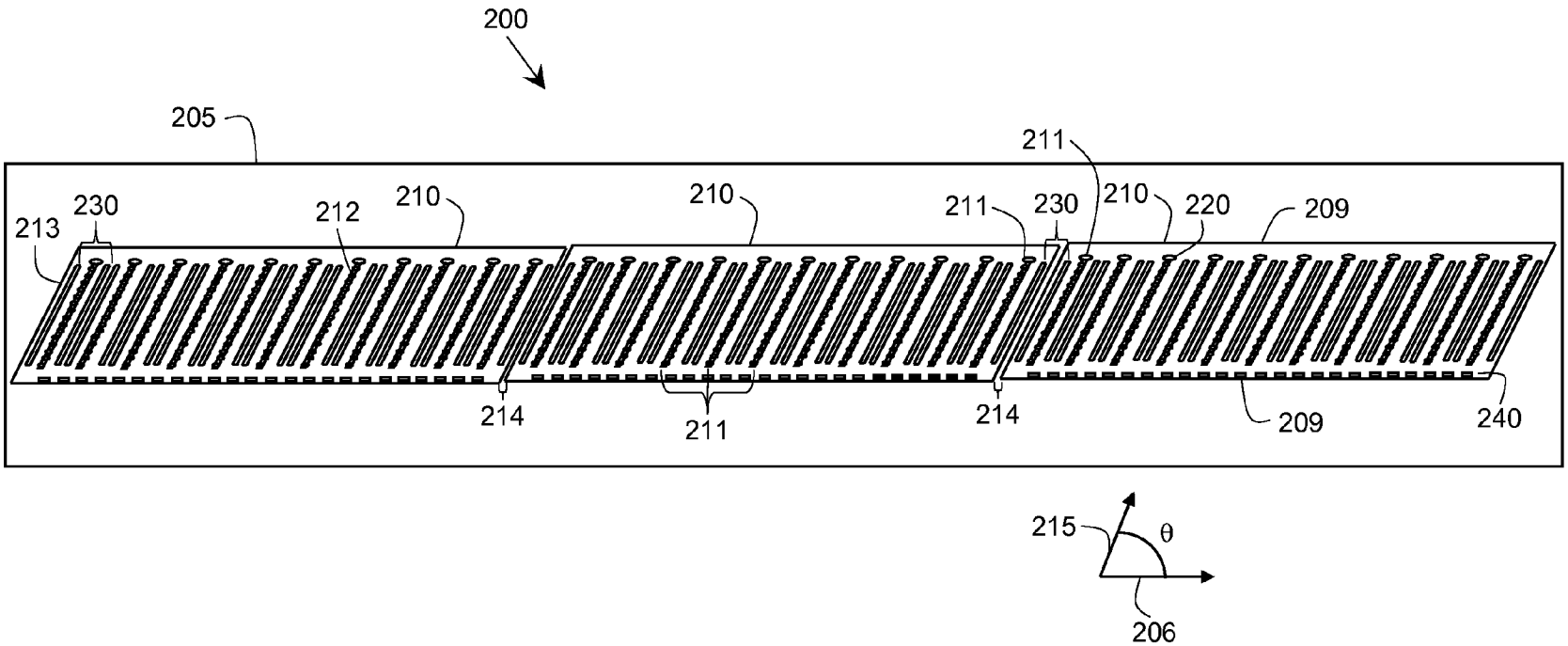
FIG. 6 is a schematic top view of a modular printhead having a row of butted printhead modules according to an embodiment of this invention.

FIG. 6 is a schematic top view of a modular printhead 200 having a row 213 of three butted printhead modules 210, according to an embodiment of this invention, but with more details provided for the printhead modules 210 than are provided in FIG. 2. In particular, ink inlets 220 of the type shown in FIG. 5, as well as electronic circuitry 230, and electrical contacts 240 are shown. In particular, portions of electronic circuitry 230 located between a butting edge 214 and an adjacent array 211 are shown for two adjacent printhead modules 210. For all three printhead modules 210 in row 213, arrays 211 of drop ejectors 212 extend along a first direction (array direction 215), and a plurality of electrical contacts 240 extend along a second direction (direction of plurality of electrical contacts 206), where the angle θ between the first direction 215 and the second direction 206 is greater than 0 degrees and less than 90 degrees. Butting edges 214 are substantially parallel to first direction 215 and nonbutting edges 209 are substantially parallel to second direction 206. Alignment features (described below with reference to at least FIGS. 10 and 11) are contactable between adjacent printhead modules 210.

In the embodiments described above, there is only one drop ejector 212 on a printhead module 210 that can line up with a given pixel site on raster line 22. In such embodiments, in order to print different colored inks, for example, a second row of printhead modules 210 can be provided on the support member 205, where the second row of printhead modules 210 is parallel to row 213. The second row of printhead modules 210 can be used to print a different color ink, or different sized dots of the same color ink, or redundant dots of the same color ink in different embodiments.

Figure 7:
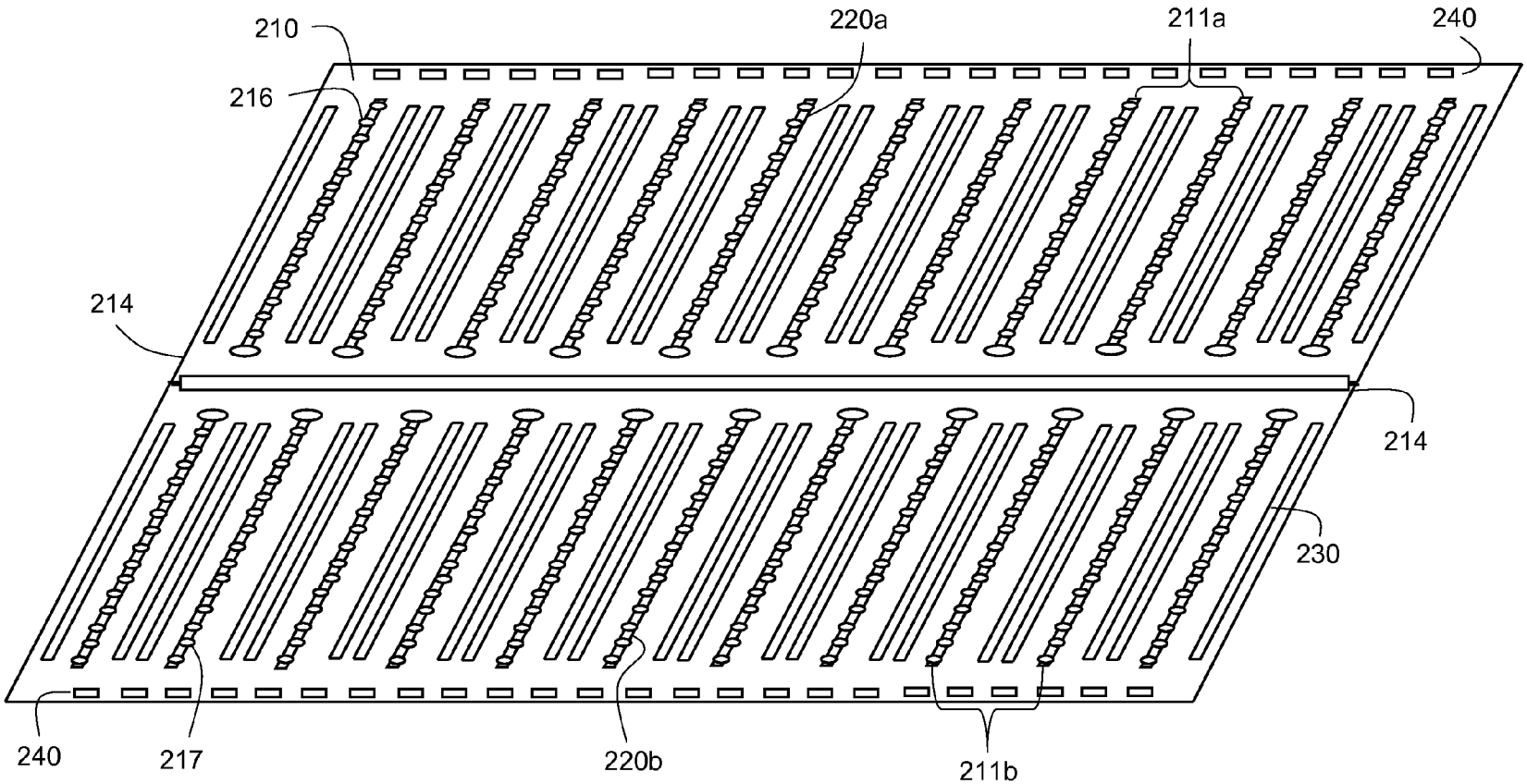
FIG. 7 is a schematic top view of a single printhead module including two sets of independent arrays according to an embodiment of this invention.

FIG. 7 shows an embodiment of the present invention in which, rather than a second row of printhead modules 210, two sets of independent arrays 211*a* and 211*b* are provided on a single printhead module 210, such that a first array 216 of the arrays 21 la has a second corresponding array 217 of the arrays 211*b*, where drop ejectors 212 in first array 216 line up (or offset at desired distance, e.g., ½ pixel) with drop ejectors 212 in corresponding second array 217. Excellent alignment of drop ejectors 212 in first array 216 and drop ejectors 212 in corresponding second array 217 is provided because first array 216 and corresponding second array 217 are fabricated together on the same printhead module 210. Thus excellent registration of dots printed by drop ejectors in first array 216 and corresponding second array 217 is readily achieved. In some embodiments of this type, different colored ink will be supplied at ink inlets 220*a* for arrays 211*a* than the ink supplied at ink inlets 220*b* for arrays 220*b*, so that the printhead module 210 of FIG. 7 can be a two-color printhead module. Four color printing (cyan, magenta, yellow and black) can be achieved by having two rows of two-color modules 210 on a support member 205, for example. In other embodiments, the same color ink is supplied at ink inlets 220*a* and 220*b*, and redundant drop ejectors 212 are thus provided in order to disguise print defects (as is well known in the art). Alternatively, if the drop ejectors 212 in arrays 211*a* provide different sized ink drops than the drop ejectors 212 in arrays 211*b*, smoother gradations in image tone can be provided.

Figure 8:
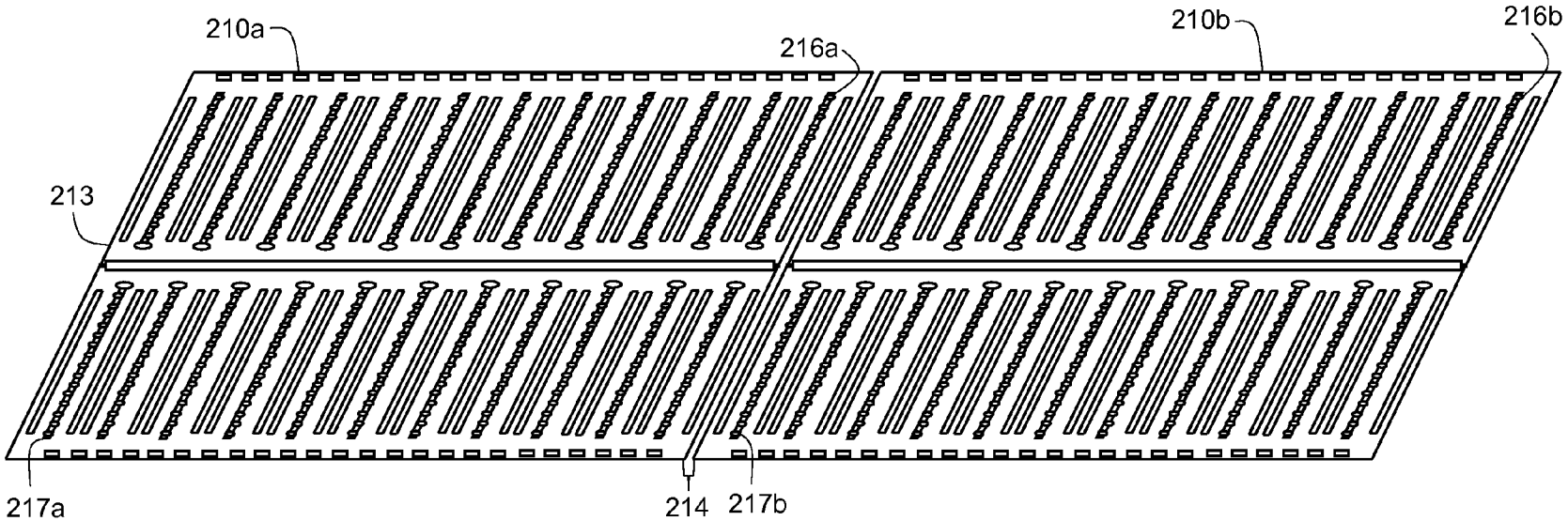
FIG. 8 is a schematic top view of a modular printhead having a row of butted printhead modules, each including two sets of independent arrays, according to an embodiment of this invention.

FIG. 8 shows a row 213 of two butted printhead modules 210*a* and 210*b* of the type shown in FIG. 7 (two butted 2-color printhead modules, for example). Note that at the butting edges 214, first array 216*a* on printhead module 210*a* has corresponding second array 217*b* that is located on printhead module 210*b*. Also note that first array 216*b* on printhead module 210*b* has no corresponding second array, and second array 217*a* on printhead module 210*a* has no corresponding first array. Thus, the very end arrays in a row 213 of printhead modules are not capable of full color printing, but that is typically small wastage.

Figure 9:
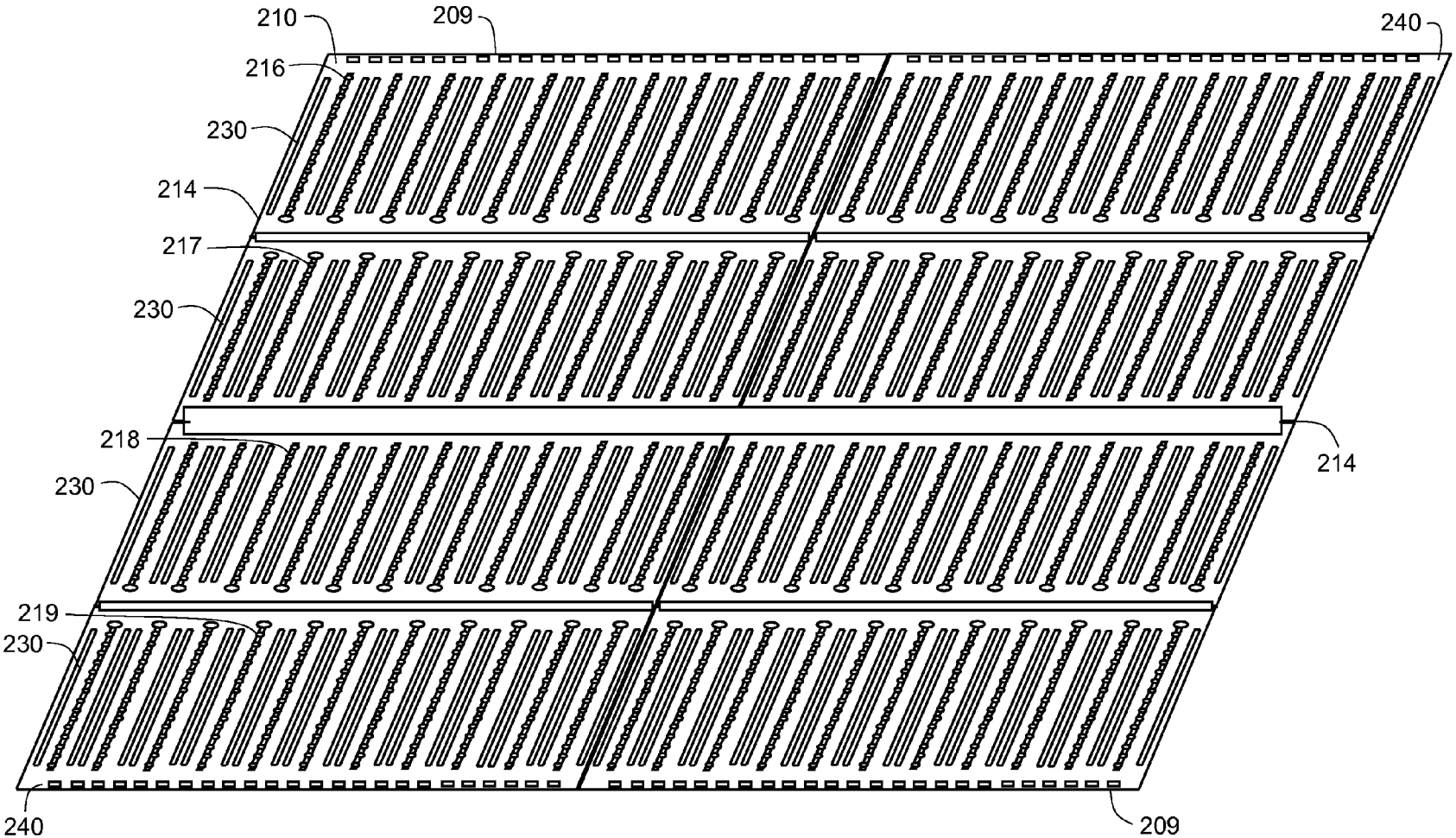
FIG. 9 is a schematic top view of a single printhead module including four sets of independent arrays according to an embodiment of this invention.

FIG. 9 shows a printhead module 210 capable of four color printing (cyan, magenta, yellow and black), according to an embodiment of the present invention. A first array 216 and its corresponding second array 217, corresponding third array 218 and corresponding fourth array 219 are indicated. Electrical contacts 240 disposed along both nonbutting edges 209 of the printhead module 210 provide signals for the electronic circuitry 230 corresponding to the arrays closest to the nonbutting edges of the printhead module 210, as well as for the electronic circuitry corresponding to arrays within the interior of the printhead module 210. In the discussion above regarding a single-color printhead module 210 having m=20 arrays 211, each array having 32 drop ejectors 212 with a d=42.3 microns and θ=60 degrees, the length of the printhead module 210 (the distance between butting edges 214) was calculated to be 13.54 mm, and the distance between nonbutting edges 209 was estimated to be around 1.3 mm. For a four-color printhead module 210 having similar array geometries, the distance between butting edges 214 would still be 13.54 mm, but the distance between nonbutting edges 209 would be about 5 mm.

Figure 10:
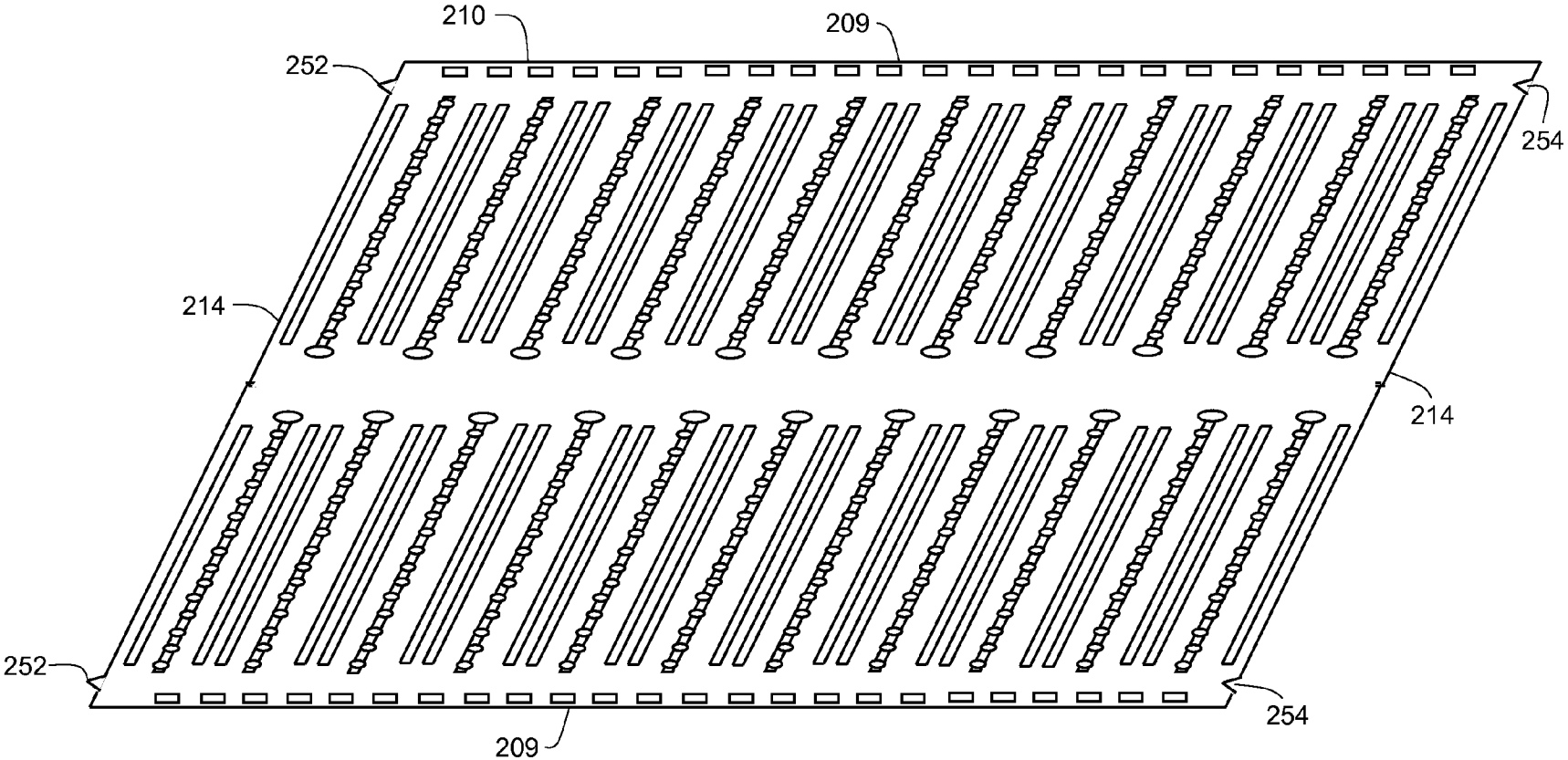
FIG. 10 is a schematic top view of a single printhead module including alignment features according to an embodiment of this invention.

In some embodiments relative alignment of the printhead modules 210 can be accomplished in various ways, for example, visually aligning the printhead modules. In other embodiments, however, alignment features can be provided such that when alignment features of adjacent printhead modules 210 contact each other, the printhead modules 210 are aligned with respect to each other. FIG. 10 schematically shows a printhead module 210 having such alignment features according to an embodiment of this invention. In the example of FIG. 10, the alignment features include two projections 252 on the butting edge 214 on the left side of the printhead module 210, and two corresponding indentations 254 on the butting edge 214 on the right side of printhead module 210. The projections 252 are sized to fit into the indentations 254 of an adjacent printhead module 210 (see FIG. 11), such that when the projections 252 contact the indentations 254 of the adjacent printhead module 210, the two printhead modules 210 are aligned relative to one another in two dimensions. Optionally, the dimensions of the projections 252 and the corresponding indentations 254 can be designed such that when projections 252 of one printhead module 210 contact the indentations 254 of an adjacent printhead module 210, a gap 256 is provided at butting edge 214, except at the contact points of the projections 252 and indentations 254. Such a gap 256 can be advantageous, in that there is less susceptibility to misalignment due to contamination or other unintended material being present at the butting edge 214. A convenient place to locate the projections 252 and indentations 254, as shown in FIG. 10, is at the butting edge 214, but near the nonbutting edge 209, because there are typically no critical features such as electronic circuitry 230 adjacent the butting edge 215 near the nonbutting edge 209.

The configuration of projections 252 and indentations 254 shown in FIG. 10 is just one example of alignment features that can be used in different embodiments of the invention. Rather than having two projections 252 on one butting edge 214 and two indentations 254 on the other butting edge 214, there can be a projection 252 near the top of one butting edge 214 and an indentation 254 near the bottom of that butting edge 214. The other butting edge 214 would have an indentation 254 near the top and a projection 252 near the bottom. In other words, a first alignment feature on a first printhead module can include two projections 252, and a second alignment feature on a second printhead module can include two indentations 254 that are complementary to the two projections 252 of the first alignment feature, as in FIGS. 10 and 11. Alternatively, the first alignment feature on the first printhead module can include a projection 252 and an indentation 254, and the second alignment feature on the second printhead module can include an indentation 254 and a projection 252 that are complementary to the projection 252 and indentation 254 of the first alignment feature.

Projections 252 and indentations 254 can have a variety of shapes, including triangular, trapezoidal, rounded, etc., as long as the indentations 254 of one printhead module 210 have the proper shape and dimensions to contact the projections 252 of the adjacent printhead module 210 and provide relative alignment of the two printhead modules 210. Projections 252 and indentations 254 can have complementary shapes relative to one another.

Many printhead modules 210 are fabricated together on a single wafer. For example, a printhead module 210 that is a thermal inkjet printhead die is typically fabricated on a silicon wafer that is around six inches or eight inches in diameter. After wafer processing is completed, it is necessary to separate the individual printhead modules 210 from the wafer. For printhead modules 210 having straight edges, the printhead modules 210 can be separated from the wafer by dicing, even if the printhead module 210 is parallelogram-shaped. However, if edges of the printhead module 210 have projections 252 extending outward, such projections 252 would be cut off during dicing. One way to precisely form the projections 252 and the corresponding indentations 254 is to use an etching process, such as deep reactive ion etching (commonly known in the art as DRIE). DRIE can provide butting alignment features with accuracy on the order of 1 micron.

Figure 11:
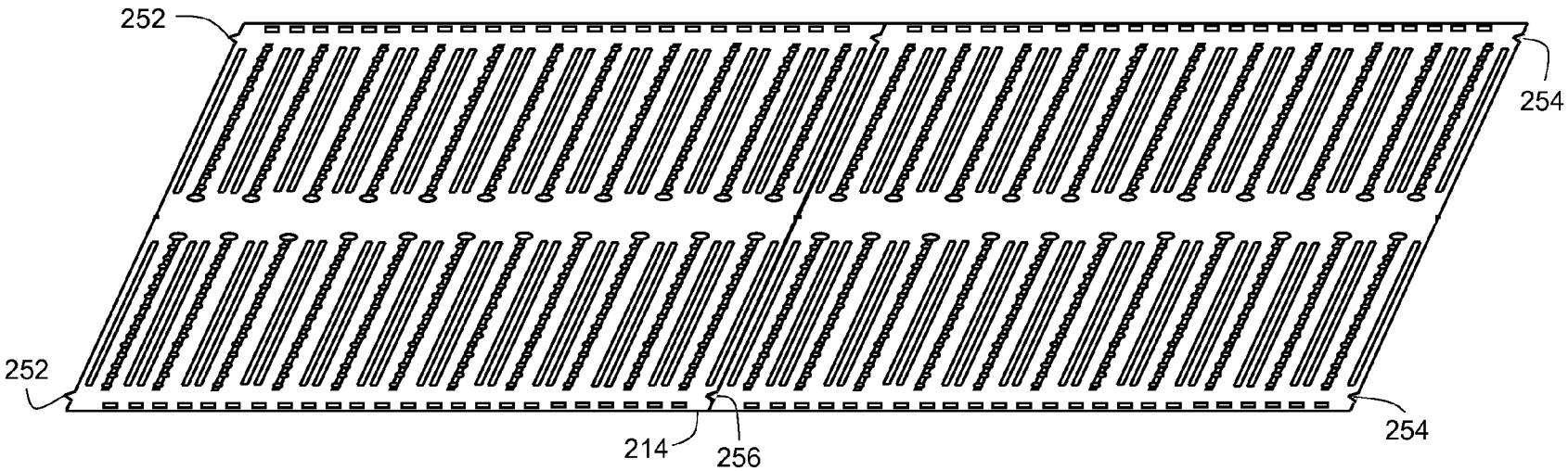
FIG. 11 is a schematic top view of two adjacent printhead modules including complementary alignment features according to an embodiment of this invention.

FIG. 11 was described above in relation to butting two adjacent printhead modules 210 together to assemble a modular printhead. However, FIG. 11 can also be used to describe the separation of two adjacent printhead modules 210 on a printhead wafer. As described above, the separation of adjacent printhead modules 210 at the projections 252 and corresponding indentations 254 on the adjacent module can be performed by DRIE. One method of achieving separation along the rest of the butting edge without cutting through projections 252 is to use a cutting operation such as water jet or laser microjet, where nonstraight cuts are possible. In water jet a high pressure, high velocity stream of water cuts by erosion. In laser microjet a pulsed laser beam is guided by a low pressure water jet, so that the water removes debris and cools the material. The width of the cut (or kerf) provided by water jet or laser microjet is typically wider than would be provided by DRIE at the projections 252 and indentations 254, so that a gap 256 is provided between adjacent printhead modules 210 when they are subsequently butted with the corresponding projections 252 and indentations 254 in contact with one another. The precision and straightness of the portions of butting edge 214 that are cut by water jet or laser microjet does not need to be as good as that provided by DRIE to make the projections 252 and indentations 254, because the gap 256 prevents those portions of the butting edge from coming into contact. Cutting of the nonbutting edges 209 can be done with water jet or laser microjet. Alternatively, after separation along the butting edges 214 of all of the printhead modules 210 on the wafer has been completed, the adjacent nonbutting edges 209 can be cut by dicing.

The invention has been described in detail with particular reference to certain preferred embodiments thereof, but it will be understood that variations and modifications can be effected within the scope of the invention. In particular, although the embodiments described above were done so with reference to inkjet drop ejectors, more generally the invention can be used for dot forming elements (other than drop ejectors) on printhead modules other than inkjet printhead modules.

PARTS LIST

10 Inkjet printer system
12 Image data source
14 Controller
15 Image processing unit
16 Electrical pulse source
18 First fluid source
19 Second fluid source
20 Recording medium
22 Raster line
100 Inkjet printhead
110 Inkjet printhead die
111 Printhead die substrate
120 First nozzle array
121 Nozzle(s) in first nozzle array
122 Ink delivery pathway (for first nozzle array)
130 Second nozzle array
131 Nozzle(s) in second nozzle array
132 Ink delivery pathway (for second nozzle array)
181 Droplet(s) (ejected from first nozzle array)
182 Droplet(s) (ejected from second nozzle array)
200 Modular printhead
205 Support member
206 Direction of plurality of electrical contacts
208 Media advance direction
209 Nonbutting edge
210 Printhead module
211 Array(s) (of drop ejectors)
212 Drop ejector(s)
213 Row
214 Butting edge(s)
215 Array direction
216 First array
217 Corresponding second array
218 Corresponding third array
219 Corresponding fourth array
220 Ink inlet(s)
221 Slots
230 Electronic circuitry
240 Electrical contacts
252 Alignment feature (projection)
254 Alignment feature (indentation)
256 Gap

The invention claimed is:

1. A modular printhead comprising:
a first printhead module comprising:
a first alignment feature;
at least one array of dot forming elements extending in a first direction along a first substrate; and
a plurality of electrical contacts operatively associated with the at least one array of dot forming elements, the plurality of electrical contacts extending in a second direction along the first substrate; and
a second printhead module comprising:
a second alignment feature;
at least one array of dot forming elements extending in a first direction along a second substrate; and
a plurality of electrical contacts operatively associated with the at least one array of dot forming elements, the plurality of electrical contacts extending in a second direction along the second substrate, wherein the first direction and the second direction of the first printhead module and the second printhead module are positioned at an angle θ relative to each other, wherein $0° < \theta < 90°$, and the first alignment feature of the first printhead module and the second alignment feature of the second printhead module are contactable with each other.

2. The printhead of claim 1, wherein the first alignment feature of the first printhead module and the second alignment feature of the second printhead module are located on an edge of the first substrate and second substrate, respectively, the edge of the first substrate and second substrate being substantially parallel to the first direction.

3. The printhead of claim 1, wherein the first alignment feature of the first printhead module and the second alignment feature of the second printhead module are complementary to each other.

4. The printhead of claim 1, wherein the dot forming elements are inkjet drop ejectors.

5. The printhead of claim 1, wherein a gap exists between the first printhead module and the second printhead module when the first alignment feature of the first printhead module and the second alignment feature of the second printhead module are in contact with each other.

6. The printhead of claim 1, wherein the first alignment feature of the first printhead module includes a projection and an indentation and the second alignment feature of the second printhead module includes an indentation and a projection that are respectively complementary to the projection and indentation of the first alignment feature.

7. The printhead of claim 1, wherein the first alignment feature of the first printhead module includes a plurality of projections and the second alignment feature of the second printhead module includes a plurality of indentations that are complementary to the plurality of projections of the first alignment feature.

8. A printhead module comprising:
a substrate;
a drop ejector array extending in a first direction along the substrate; and
a plurality of electrical contacts operatively associated with the at least one drop ejector array, the plurality of electrical contacts extending in a second direction along the substrate, the first direction and the second direction being positioned at an angle θ relative to each other, wherein 0°<θ<90°.

9. The printhead module of claim 8, wherein the substrate is a parallelogram including an angle between adjacent sides that is less than 90°.

10. The printhead module of claim 8, wherein the substrate includes one side that is parallel to the first direction and a second side that is parallel to the second direction.

11. The printhead module of claim 8, further comprising:

an alignment feature that is located on an edge of the substrate, the edge of the substrate being substantially parallel to the first direction.

12. The printhead module of claim 8, further comprising:

an alignment feature including a projection and an indentation.

13. The printhead module of claim 8, further comprising:

an alignment feature including a plurality of one of projections, indentations, and combinations thereof.

14. The printhead module of claim 8, the drop ejector array being a first drop ejector array, further comprising:

a second drop ejector array extending in the first direction along the substrate, wherein one drop ejector of the first drop ejector array is projectionally adjacent to one drop ejector of the second array when viewed along a plane perpendicular to the second direction.

15. A printhead module comprising:

a substrate including a butting edge extending in a first direction along the substrate;

a plurality of drop ejector arrays formed on the substrate extending substantially parallel to the butting edge of the substrate, a first drop ejector array of the plurality of drop ejector arrays being closest to the butting edge of the substrate; and electronic circuitry formed on the substrate, wherein a portion of the electronic circuitry is disposed between the first drop ejector array and the butting edge of the substrate.

16. The printhead module of claim 15, the plurality of drop ejector arrays being a first plurality of drop ejector arrays for ejecting a first ink, further comprising:

a second plurality of drop ejector arrays for ejecting a second ink that is different from the first ink.

17. A method of forming an individual printhead module including an alignment feature comprising:

providing a wafer including a plurality of printhead modules;

forming a first alignment feature on a first printhead module of the plurality of printhead modules and forming a complementary second alignment feature on a second printhead module of the plurality of printhead modules using an etching process; and separating the plurality of printhead modules using a cutting operation to cut the wafer.

18. The method of claim 17, wherein forming the first alignment feature on the first printhead module of the plurality of printhead modules and forming the complementary second alignment feature on the second printhead module of the plurality of printhead modules includes separating the first printhead module and the second printhead module from each other.

19. The method of claim 17, wherein the etching process is performed on a first edge of the first printhead module and the cutting operation is performed on an adjacent second edge of the first printhead module.

20. The method of claim 17, the cutting operation being a second cutting operation, wherein the etching process and a first cutting operation are performed on a first edge of the first printhead module and the . second cutting operation is performed on an adjacent second edge of the first printhead module subsequent to the etching process being performed.

21. The method of claim 17, wherein the first alignment feature includes a projection and an indentation and the second alignment feature includes an indentation and a projection that are respectively complementary to the projection and indentation of the first alignment feature.

22. A modular printhead comprising:

a first printhead module comprising:

at least one array of dot forming elements extending in a first direction along a first substrate; and a plurality of electrical contacts operatively associated with the at least one array of dot forming elements, the plurality of electrical contacts extending in a second direction along the first substrate; and a second printhead module comprising:

at least one array of dot forming elements extending in a first direction along a second substrate; and a plurality of electrical contacts operatively associated with the at least one array of dot forming elements, the plurality of electrical contacts extending in a second direction along the second substrate, the first direction and the second direction of the first printhead module and the second printhead module being positioned at an angle θ relative to each other, wherein 0°<θ<90°.

23. The printhead of claim 22, wherein the dot forming elements are inkjet drop ejectors.

* * * * *